United States Patent [19]

Busse-Machukas et al.

[11] Patent Number: 4,564,434

[45] Date of Patent: Jan. 14, 1986

[54] ELECTRODE FOR ELECTROLYSIS OF SOLUTIONS OF ELECTROLYTES

[76] Inventors: Vladimir B. Busse-Machukas, Izmailovsky bulvar, 37, kv. 27; Florenty I. Lvovich, I Nizhne-Mikhailovsky proezd, 16, kv. 55; Evdokia K. Spasskaya, Vishnyakovskaya ulitsa 6, korpus 3, kv. 97; Vladimir L. Kubasov, Kirovogradskaya ulitsa, 4, korpus 2, kv. 135; Anatoly F. Mazanko, Stavropolskaya ulitsa, 56, korpus 1, kv. 73; Ernest A. Druzhinin, Gvardeiskaya ulitsa, 4, kv. 32; Alexandr N. Martynov, Yakornava ulitsa, 10, korpus 1, kv. 60; Ljudmila N. Nelipa, bulvar Matrosa Zheleznyaka, 11, kv. 2, all of, Moscow, U.S.S.R.

[21] Appl. No.: 656,163

[22] Filed: Sep. 28, 1984

[51] Int. Cl.[4] ..... C25B 11/00

[52] U.S. Cl. ..... 204/290 F; 204/98; 204/128

[58] Field of Search ..... 204/290 F

[56] References Cited

U.S. PATENT DOCUMENTS

| | | | |
|---|---|---|---|
| 3,810,770 | 5/1974 | Bianchi | 204/290 F |
| 3,846,273 | 11/1974 | Bianchi | 204/290 F |
| 3,853,738 | 12/1974 | Loftfield | 204/290 F |
| 3,948,751 | 4/1976 | Bianchi | 204/290 F |
| 4,318,795 | 3/1982 | Bianchi | 204/290 F |
| 4,426,263 | 1/1984 | Hardee | 204/290 F |

*Primary Examiner*—John F. Niebling

*Attorney, Agent, or Firm*—Burgess, Ryan & Wayne

[57] ABSTRACT

The present invention relates to electrochemistry.

An electrode for electrolysis of solutions of electrolytes comprises a support of a metal liable to passivation and a coating, applied onto this support, consisting of a mixture wherein a molar ratio of titanium oxide to the total of oxides of iridium and ruthenium is equal to 1–3:1 at a molar ratio of iridium oxide to ruthenium oxide equal to 0.75–3:1.

3 Claims, No Drawings

ELECTRODE FOR ELECTROLYSIS OF SOLUTIONS OF ELECTROLYTES

The present invention relates to electrochemistry, more particularly, to electrolysis of solutions of electrolytes and, still more specifically, to an electrode for electrolysis of solutions of electrolytes.

FIELD OF THE INVENTION

The present invention is useful as an anode in electrolysis of solutions of chlorides of alkali metals to produce chlorine and an alkali in electrolyzers with a filtering membrane or with an ion-exchange membrane and in mercury-cathode electrolyzers, as well as in electrolytical processes for the production of chlorates, hypochlorites, in processes of an electrochemical purification of waste waters, in electroplating processes.

BACKGROUND OF THE INVENTION

Prior to the beginning of the 1970s mainly graphite electrodes were used as anodes in electrochemical processes. Graphite anodes have a number of advantages, namely: an inexpensive and readily-available electrode material is used, the anodes are insensitive towards short-circuits. At the same time, however, graphite anodes are catalytically less active which necessitates a high voltage on the electrolyzer, they also have a high abrasion degree thus causing a frequent disassembling of the electrolyzer for replacement of anode sets. Furthermore, graphite anodes have high overall dimensions and weight which results in an undesirable increase of the electrolyzer size, as well as floor space of the electrolysis shops.

At the present time in electrochemical processes metal-oxide anodes which comprise a current-conducting support with an active coating of metal oxides deposited thereon are extensively used. The current-conducting support is made of a metal passivated by anodic polarization, for example, titanium, tantalum, zirconium, niobium, or an alloy of these metals. The current-conducting support or base can be made of any shape, for example in the form of a flat plate with or without perforation, or in the form of a rod, screen, grid, a metal-ceramic body.

Known in the art is an electrode for electrochemical processes comprising a current-conducting support, for example, of titanium with an active coating of a mixture of oxides of titanium, iridium and ruthenium applied thereon. The content of titanium oxides in this coating is considerable and amounts to more than 75 molar percent. For example, in such prior art electrode, the coating has the following composition, molar percent: $IrO_2$—3.91, $RuO_2$—7.43 and $TiO_2$—88.66 (samples B and D taught in U.S. Pat. No. 3,948,751, Table 2); $IrO_2$—7.25, $RuO_2$—13.8 and $TiO_2$—78.95 (sample C, U.S. Pat. No. 3,948,751, Table 2).

As it is clear from the above proportions, the coating ingredients in the above electrode are present in the following ratio (mol.%): $TiO_2(IrO_2+RuO_2)=(3.8-7.8):1$ and $IrO_2$: $RuO_2=0.5:1$ (cf. U.S. Pat. No. 3,948,751, Cl. 204-290F., 1976).

This prior art electrode features instability of the anode potential in electrolysis, a low current yield and an insufficient resistance of the electrode in operation.

Thus, in testing samples "B", "C" and "D" in a saturated NaCl solution at the current density of 1 A/cm$^2$ and temperature of 65° C. the anode potential of sample "B" varied within the range of from 1.53 to 1.62 V during 2,000 hours of electrolysis (about 83 days); the anode potential of sample "C"—within the range of from 1.35 to 1.38 V during 2,300 hours (about 96 days) of electrolysis and that of sample "D"—within the range of from 1.44 to 1.50 V during 816 hours (34 days) of electrolysis.

The most extensive use has been enjoyed by metal-oxide anodes with an active coating containing 30 mol.% of ruthenium dioxide and 70 mol.% of titanium dioxide known in the art as DSA (dimensionally-stable anodes) and in the USSR available under the registered trademark OPTA. The OPTA electrodes are protected by the USSR Inventor's Certificate No. 369923.

The rate of consumption of the active mass of this electrode under stationary chlorine electrolysis conditions at a current density of 0.2 to 0.4 A/cm$^2$, as determined by the radiochemical method, is equal to $2.6\times10^{-8}$ g/cm$^2$.hr.

The resistance of the active coating of an electrode can be determined by the method of variable polarity and amalgamation which is widely used as a rapid method for the evaluation of quality of an active coating: amalgamation resistance, adhesion to the current-conducting support, resistance to cathodic polarization and shortcircuit resistance.

The results of measurements of consumption of the active coating mass of an OPTA electrode obtained by the method of variable polarity and amalgamation are shown in the following Table.

| Number of testing cycles | 1–3 | 4–6 | 7–9 | 10–12 | 13–15 | 16–18 |
|---|---|---|---|---|---|---|
| Consumption of the active mass for every 3 successive testing cycles, mg/cm$^2$ | 0.595 | 0.610 | 0.140 | 0.180 | 0.190 | 0.170 |

An OPTa electrode, as compared to a graphite one, under conditions of electrolysis of chlorides of alkali metals makes it possible to lower overtension of chlorine evolution, to reduce voltage on the electrolyzer and to save about 200 kW.hr per ton of caustic soda (as calculated for a 100% product), as well as to improve purity of the electrolysis products, extend the service life of anodes from 7–8 months to 5–7 years and reduce costs of electrode reassembling. However, an OPTA electrode has the following disadvantages: a relatively high rate of consumption of noble metals especially noticeable in a mass-scale use of such electrodes; an insufficient resistance of the coating under conditions of a combined evolution of oxygen and chlorine; at an increased content of oxygen in the anodic gas a "closing" of electrode occurs at a still high residual content of ruthenium in the active coating of the electrode. These factors impair the operation reliability of this electrode, especially under conditions of electrolysis with an ion-exchange membrane.

BACKGROUND OF THE INVENTION

It is an object of the present invention to provide such an electrode for electrolysis of solutions of electrolytes which would have an improved resistance, especially under conditions of a combined evolution of oxygen and chlorine on the anode.

It is another object of the present invention to provide such an electrode for electrolysis of solutions of electrolytes which would ensure a stable value of the anode potential at a long-time electrolysis.

SUMMARY OF THE INVENTION

These objects are accomplished by an electrode comprising a support of a passivated metal provided with a coating of a mixture of oxides of titanium, iridium and ruthenium with a content of titanium oxide above 50 mol.%, in accordance with the present invention the coating contains the above-mentioned ingredients in a molar ratio of titanium oxide to the total of oxides of iridium and ruthenium equal to 1–3:1 at a molar ratio of iridium oxide to ruthenium oxide equal to 0.75–3:1.

The electrode according to the present invention adapted for electrolysis of solutions of electrolytes has a stability, evaluated by loss of the active mass using the method of variable polarity and amalgamation and electrolysis under severe conditions (electrolyte—200 g/l of NaOH), exceeding by about 1.5–2 times that of the electrode according to U.S. Pat. No. 3,948,751 (samples 2 and 3) and by twice that of the OPTA electrode disclosed in the USSR Inventor's Certificate No. 369923. Stability of catalytical properties of the electrode according to the present invention relative to the OPTA electrode is especially manifested in the case of an increased content of oxygen in chlorine up to evolution of pure oxygen. Stability of the electrode according to the present invention in comparison with the OPTA electrode can be assessed as superior by 1.5–2 times.

According to the present invention, it is advisable that the electrode coating contain the above-specified ingredients in a molar ratio of titanium oxide to the total of oxides of iridium and ruthenium equal to 1.75–3:1 at a molar ratio of iridium oxide to ruthenium oxide equal to 0.75–1.75:1.

According to an embodiment of the present invention, the electrode coating contains the above-specified ingredients in a molar ratio of titanium oxide to the total of iridium oxide and ruthenium oxide equal to 1.25–2.5:1 at a molar ratio of iridium oxide to ruthenium oxide equal to 1.25–2.5:1.

Further objects and advantages of the present invention will now become more fully apparent from the following detailed description of the electrode for electrolysis of solutions of electrolytes and specific examples given by way of illustration.

DETAILED DESCRIPTION OF THE INVENTION

An electrode for electrolysis of solutions of electrolytes is made of a metal which is passivated upon an anodic polarization, for example such as titanium, tantalum, zirconium, niobium or an alloy thereof which serves as a support or base of the electrode.

The electrode support can be of any shape, for example in the form of a flat plate with or without perforation, a rod, a screen, a grid or a metal-ceramic body.

The electrode support is provided with a coating of a mixture of oxides of titanium, iridium and ruthenium.

According to the present invention, these oxides should be present in a molar ratio of titanium oxide to the total of iridium oxide and ruthenium oxide of 1–3:1 at a molar ratio of iridium oxide to ruthenium oxide equal to 0.75–3:1 respectively. This condition makes it possible to improve stability of the electrode with such coating by about 2 times under conditions of a combined evolution of oxygen and chlorine and to obtain a stable value of the anode potential in a lasting electrolysis process.

Therefore, it has been quite unexpectedly found that it is possible to considerably improve resistance of the electrode and stability of its operation at a partial replacement of ruthenium oxide with iridium oxide in the ratio according to the present invention in respect of a known coating.

A high corrosion-resistance of metal-oxide coatings containing oxides of titanium and platinum-group metals is associated with the known fact of the formation, by them, of substitution solutions. The presence of a free phase of individual oxides of platinum-group metals results in higher losses of noble metals. The introduction of iridium oxide into the active mass of the electrode—into its coating—contributes to an increase of its corrosion resistance under conditions of a combined evolution of oxygen and chlorine, since iridium is not liable to the formation of volatile oxygen compounds. The effect of introduction of iridium oxide has proven to be considerable at a simultaneous presence, in the coating, of ruthenium dioxide, since it is only in this particular case that the conditions are provided for the formation of solid solutions within the entire range of concentrations of the coating ingredients according to the present invention, thus resulting in an essential increase in the electrolytic resistance of the coating and a better catalytic activity. The ratio of iridium dioxide to ruthenium dioxide should be equal to 0.75–3:1, since within this interval, as we have found, the catalytical activity is maximal and at the same time a high resistance of the electrode coating is ensured. It should be noted that an increased corrosion resistance is especially manifested under conditions of evolution of oxygen upon electrolysis of solutions of hydroxides of alkali metals where individual ruthenium oxide is substantially instable.

At a molar ratio of titanium oxide to the total of iridium and ruthenium oxides of below 1:1, losses of noble metals during electrolysis are increased apparently due to the formation of a free phase of individual oxides of iridium and ruthenium. At an elevation of the ratio of titanium oxide to the total of iridium oxide and ruthenium oxide above 3:1, the catalytic activity of the coating is lowered apparently due to an alteration of the nature of conductivity upon enrichment of the coating with titanium oxide which is an n-type semiconductor.

At a molar ratio of iridium oxide to ruthenium oxide of less than 0.75–1:1, the resistance of the coating is reduced, especially in respect of the evolving oxygen, while at a ratio above 3:1, the adhesion properties of the coating are impaired.

The electrode according to the present invention can be produced by a conventional process.

For example, a titanium base of the electrode is preliminarily degreased, etched, rinsed in deionized water and dried, whereafter an active coating is applied onto the preconditioned titanium base by various known methods. For example, a coating solution is prepared which contains thermodecomposable compounds of metals of the components of the active coating—iridium, ruthenium and titanium. After application of the solution onto the base, the electrode is dried and then calcined at an elevated temperature. In doing so, thermal decomposition of the compounds occurs with the formation of a mixture of oxides of respective metals. The coating is made multi-layered. Each layer is deposited in accordance with the already described procedure. The number of layers is determined by the target proportion of the active coating which must be applied onto a unit surface area.

Another known process which can be used for application of an active coating onto the electrode support comprises an electron-beam treatment of a mixture of oxides preliminarily uniformly deposited onto the surface of the current-conducting base by sedimentation. According to this procedure, a finely divided powder-like mixture of oxides of titanium, iridium and ruthenium is deposited by sedimentation in an alcohol or acetone onto a titanium support placed on the bottom of a vessel. The electrode with the deposited powder is then dried and calcined. The thus-produced blank is placed into a vacuum chamber, wherein it is subjected to an electron-beam treatment.

The composition of the thus-produced coating can be analyzed, for example, by the analytical chemistry methods such as peeling the coating layer from the substrate, fusing a fragment of the coating layer to separate it from the support, smelting a fragment of the coating with alkalis or oxides of alkali metals, dissolution and a subsequent chemical determination using any known method of quantitative analysis.

EXAMPLE 1

An electrode is produced with an active coating having the following composition, molar percent: $TiO_2$—70.8, $IrO_2$—12.5, $RuO_2$—16.7 at the ratio $TiO_2$:-($IrO_2+RuO_2$)=2.44:1 and $IrO_2$:$RuO_2$=0.75:1.

The electrode is produced in the following manner.

A titanium plate (with the size of 20×30×2 mm) is degreased in a solution containing 5 g/l of NaOH, 30 g/l of $Na_3PO_4$ and 40 g/l of $Na_2CO_3$ at a temperature of 80° C. for 10 minutes, washed and etched for 15 minutes in a solution of HCl (25% by weight) at a temperature of 100° C., followed by rinsing in deionized water and drying at a temperature of 40° C.

For application of an active coating, a coating solution is prepared from the following starting solutions: a solution of ruthenium hydroxychloride ($RuOHCl_3$) in water at a concentration of 150 g/l; a solution of titanium tetrachloride ($TiCl_4$) in water at a concentration of 220 g/l (as calculated for $TiO_2$); a solution of iridium trichloride ($IrCl_3$) at a concentration of 199.6 g/l.

The coating solution for application of the active coating is prepared by mixing the above-mentioned solutions of ruthenium hydroxychloride and titanium tetrachloride and the addition, to the mixed solution of $RuOHCl_3$-$TiCl_4$, of a solution of iridium trichloride ($IrCl_3$).

The coating solution contains 5.35 $cm^3$ of a solution of $RuOHCl_3$, 5.35 $cm^3$ of a solution of $TiCl_4$ and 4.0 $cm^3$ of a solution of $IrCl_3$. The active coating is made multi-layered. Each layer is applied according to the following procedure: rate of consumption of the coating solution for the 1-st layer is 25–30 ml/$m^2$. In this manner 4–6 layers are applied. The total consumption of noble metals is 7–9 g/$m^2$ of the working surface. After application of each layer, the electrode is first dried at a temperature of 150° C., then calcined at a temperature of 350° C. for 20 minutes to treat the first 2–3 layers, the subsequent layers are calcined at a temperature of from 450° to 500° C. for a period of from 20 to 40 minutes.

The electrode was subjected to testing for determination of its anodic potential and resistance.

Measurements of the anodic potential were carried out under the conditions of chlorine electrolysis; concentration of a solution of sodium chloride—280 g/l, temperature 90° C., pH=3.0–3.5, current density—1,000; 2,000; 4,000; 6,000 and 10,000 A/$m^2$ and under the conditions of chlorate electrolysis: 400 g/l of $NaClO_3$, 100 g/l of NaCl, pH=7, current density—1,000–3,000 A/$m^2$, temperature—80° C.

The resistance of electrodes was evaluated using several procedures for the study of wear-resistance of electrodes: by the method of variable polarity and amalgamation; by electrolysis in a solution of NaOH.

The method of variable polarity and amalgamation resides in the following: a test sample is subjected to an alternating anodic and cathodic polarization for 40 minutes at a current density of 1 A/$cm^2$ and a temperature of 60° C. in a solution of sodium chloride with the concentration of 300 g/l. Then the electrode is submerged into sodium amalgam for 30 seconds, the sodium concentration being 0.2% by weight. After such treatment, the electrode is rinsed in distilled water, dried and its weight loss is then determined.

The wear-resistance of electrodes in electrolysis of NaOH solutions is studied under the following conditions: concentration of NaOH solution—200 g/l, temperature 90° C., current density—2 A/$cm^2$; the sample weight losses are determined, as well as the time elapsed till "closing" of the anode.

The thus-manufactured and tested electrode fully corresponds to the electrode according to the present invention.

The test results (sample A) are shown in the Table below.

EXAMPLE 2

An electrode is produced in a manner similar to that described in the foregoing Example 1, except that it has an active coating of the following composition, molar percent: $TiO_2$—70.0, $IrO_2$—15.0, $RuO_2$—15.0 at a ratio of $TiO_2$:($IrO_2+RuO_2$)=2.33:1 and $IrO_2$:$RuO_2$=1:1.

For application of an active coating, a coating solution is prepared by mixing the solutions mentioned in Example 1: a solution of ruthenium hydroxychloride and solution of titanium tetrachloride, followed by the addition of a solution of iridium trichloride ($IrCl_3$) to the mixed solution of $RuOHCl_3$-$TiCl_4$.

The coating solution contains 4.8 $cm^3$ of a solution of $RuOHCl_3$, 5.2 $cm^3$ of a solution of $TiCl_4$ and 4.8 $cm^3$ of a solution of $IrCl_3$.

The test results are shown in the Table below (sample B).

EXAMPLE 3

An electrode is produced in a manner similar to that described for the electrode of Example 1 hereinbefore, except that the active coating has the following composition, molar percent: $TiO_2$—70.0, $IrO_2$—20.0, $RuO_2$—10.0 at a ratio of $TiO_2$:($IrO_2+RuO_2$)=2.33:1 and $IrO_2$:$RuO_2$=2:1.

The coating solution for application of the active coating is prepared by mixing the solutions of ruthenium hydroxychloride and titanium tetrachloride mentioned in Example 1, followed by the addition of a solution of iridium trichloride ($IrCl_3$) to the mixed solution of $RuOHCl_3$-$TiCl_4$.

The coating solution contains 3.2 $cm^3$ of the solution of $RuOHCl_3$, 5.3 $cm^3$ of the solution of $TiCl_4$ and 6.4 $cm^3$ of the solution of $IrCl_3$.

The composition of the thus-produced electrode corresponds to that of the electrode according to the present invention. The test results are shown in the Table below (sample C).

EXAMPLE 4

An electrode is produced in a manner similar to that described for the electrode of Example 1, except that the active coating has the following composition, molar percent: $TiO_2$—75.0, $IrO_2$—18.7, $RuO_2$—6.3 at a ratio of $TiO_2:(IrO_2+RuO_2)=3:1$ and $IrO_2:RuO_2=3:1$.

For application of the active coating, a coating solution is prepared by mixing the solutions of ruthenium hydroxychloride and titanium tetrachloride mentioned in Example 1 hereinbefore, as well as by the addition, to the mixed solution of $RuOHCl_3$-$TiCl_4$, of a solution of iridium trichloride ($IrCl_3$).

The coating solution contains 2.0 $cm^3$ of a solution of $RuOHCl_3$, 5.7 $cm^3$ of a solution of $TiCl_4$ and 6.0 $cm^3$ of a solution of $IrCl_3$.

The electrode produced in this Example (sample D) corresponds, as to the composition thereof, to the electrode according to the present invention.

EXAMPLE 5

An electrode is produced in a manner similar to that described in Example 1, except that the active coating has the following composition, molar percent: $TiO_2$—50.0; $IrO_2$—30.0, $RuO_2$—20.0 at a ratio of $TiO_2:(IrO_2+RuO_2)=1:1$ and $IrO_2:RuO_2=1.5:1$.

For application of the active coating, a coating solution is produced by mixing the solutions of ruthenium hydroxychloride and titanium tetrachloride mentioned in Example 1 with the addition, to the mixed solution of $RuOHCl_3$ and $TiCl_4$, of a solution of iridium trichloride ($IrCl_3$).

The coating solution contains 6.4 $cm^3$ of the solution of $RuOHCl_3$, 3.8 $cm^3$ of a solution of $TiCl_4$ and 9.6 $cm^3$ of a solution of $IrCl_3$.

The produced electrode corresponds to the electrode according to the present invention.

The results of testing the thus-produced electrode (sample E) are shown in the Table below.

EXAMPLE 6

An electrode is produced which comprises a current-conducting titanium substrate with the size of $20\times30\times2$ mm with a deposit thereon of an active coating having the following composition, molar percent: $TiO_2$—63.5, $IrO_2$—23.3, $RuO_2$—13.2 at a ratio of $TiO_2:(IrO_2+RuO_2)=1.75:1$ and $IrO_2:RuO_2=1.75:1$. The electrode is produced in the following manner.

The titanium plate is degreased in a solution containing 5 g/NaOH, 30 g/l of $Na_3PO_4$, 40 g/l of $Na_2CO_3$ at a temperature of 80° C. for 10 minutes; after rinsing, it is etched in a 25% solution of HCl at a temperature of 100° C. for 15 minutes and then washed in deionized water, followed by drying at a temperature of 40° C.

For application of an active coating, a mixture of oxides of titanium, iridium and ruthenium is disintegrated and screened through a sieve with openings of 30 μm. The screened powder is mixed with an alcohol or acetone. Taking into account the surface area of the titanium substrate, a weighed portion of the mixture of oxides is taken in an amount of 1.5–2 mg/$cm^2$. The powder is uniformly deposited onto the titanium substrate by sedimentation which substrate is at the bottom of a vessel. The electrode with the deposited powder is dried and then calcined in the air at a temperature within the range of from 450° to 600° C. for 10 to 20 minutes. The thus-produced blank is placed into a vacuum chamber of a unit wherein it is subjected to the treatment with an electron beam with the scanning frequency of 20 Hz and treatment current of 80 μA. The thus-manufactured electrode corresponds to the electrode according to the present invention. The test results are shown in the Table below.

EXAMPLE 7

An electrode is produced in a manner similar to that described for the electrode of Example 1, except that its active coating has the following composition, molar percent: $TiO_2$—55.6, $IrO_2$—24.7, $RuO_2$—19.7 at a ratio of $TiO_2:(IrO_2+RuO_2)=1.25:1$ and $IrO_2:RuO_2=1.25:1$.

For application of the active coating, a coating solution is prepared by mixing the solutions of ruthenium hydroxychloride and titanium tetrachloride specified in Example 1 with the addition, to the mixed solution of $RuOHCl_3$-$TiCl_4$, of a solution of iridium trichloride ($IrCl_3$).

The coating solution contains 6.3 $cm^3$ of a solution of $RuOHCl_3$, 4.2 $cm^3$ of the solution of $TiCl_4$ and 7.9 $cm^3$ of a solution of $IrCl_3$.

The resulting electrode (sample G) corresponds, as regards its composition, to the electrode according to the present invention.

The test results are shown in the Table hereinbelow.

EXAMPLE 8

An electrode is produced in a manner similar to that described for the electrode of Example 1 hereinbefore, except that the active coating has the following composition, molar percent: $TiO_2$—66.7, $IrO_2$—23.8, $RuO_2$—9.52 at a ratio of $TiO_2:(IrO_2+RuO_2)=2:1$ and $IrO_2:RuO_2=2.5:1$.

For application of the active coating, a coating solution is prepared by mixing the solutions of ruthenium hydroxychloride and titanium tetrachloride mentioned in Example 1 and by the addition, to the mixed solution of $RuOHCl_3$-$TiCl_4$, of a solution of iridium trichloride ($IrCl_3$). The coating solution contains 3.0 $cm^3$ of a solution of $RuOHCl_3$, 5.1 $cm^3$ of a solution of $TiCl_4$ and 7.6 $cm^3$ of a solution of $IrCl_3$.

The thus-produced electrode has a composition corresponding to the electrode according to the present invention. The results of the tests are shown in the Table below (sample H).

EXAMPLE 9

An electrode is produced in a manner similar to that described for the electrode of Example 1, except that the active coating has the following composition, molar percent: $TiO_2$—45.0, $Ir_2O$—22.0, $RuO_2$—33 at a ratio of $TiO_2:(IrO_2+RuO_2)=0.82:1$ and $IrO_2:RuO_2=0.67:1$.

For application of the active coating, a coating solution is prepared by mixing the solutions of ruthenium hydroxychloride and titanium tetrachloride mentioned in Example 1 with the addition, to the resulting mixed solution of $RuOHCl_3$-$TiCl_4$, of a solution of iridium trichloride ($IrCl_3$).

The coating solution contains 10.5 $cm^3$ of a solution of $RuOHCl_3$, 3.4 $cm^3$ of a solution of $TiCl_4$ and 7.0 $cm^3$ of a solution of $IrCl_3$.

The resulting electrode (sample J) illustrates an electrode with an active coating containing oxides of titanium, ruthenium and iridium, the content of titanium oxide in the mixture being less than 50 mol.%.

The results of tests of this sample are shown in the Table hereinbelow.

EXAMPLE 10

An electrode produced as in Example 2 with an active coating containing, molar percent: $TiO_2$—70.0, $IrO_2$—15.0, $RuO_2$—15.0 was tested under conditions of electrolysis of waste waters containing 27.5 mg/l of phenols at a pH=4 and current density of 2.8 A/dm$^2$. The effect of purification of the waste waters from phenols is 95% at the power consumption rate of 32 kW-hr/m$^3$.

EXAMPLE 11

An electrode produced as in Example 2 with an active coating incorporating, molar percent: $TiO_2$—70.0, $IrO_2$—15.0, $RuO_2$—15.0 is used in the process of gold-plating of articles. The electrolyte contains $KAu(CN)_2$—30 g/l, citric acid—100 g/l, KOH—40 g/l, cobalt sulphate—100 mg/l.

The process is conducted at a pH of 3.5, temperature of 30° C., current density—10 mA/cm$^2$. The current yield in the process of gold-plating of a copper cathode is 90%.

EXAMPLE 12

Several electrodes were produced and tested for the purpose of comparison.

An electrode is produced which comprises a current-conducting substrate in the form of a titanium plate of 20×30×2 mm size with a deposit thereon of an active coating having the following composition, molar percent: $TiO_2$—67.0, $RuO_2$—33.0 and at a ratio of $TiO_2$:-$RuO_2$=2:1.

The coating solution contains 10.6 cm$^3$ of a solution of $RuOHCl_3$ and 5.2 cm$^3$ of a solution of $TiCl_4$. The application of the coating solution was effected as described in Example 1 hereinbefore.

The thus-produced electrode (sample 1) has a composition corresponding to that of the known OPTA electrode according to the USSR Inventor's Certificate No. 369923.

The results of tests of this electrode are shown in the Table hereinbelow (sample 1).

An electrode is produced in a manner similar to that described for the electrode of Example 1, except that its active coating contains the following components, molar percent: $TiO_2$—88.66, $IrO_2$—3.91, $RuO_2$—7.43 at a ratio of $TiO_2$:($IrO_2$+$RuO_2$)=7.8:1 and $IrO_2$:-$RuO_2$=0.528:1.

For application of the active coating, a coating solution is prepared by mixing the solutions of ruthenium hydroxychloride and titanium tetrachloride mentioned in Example 1 with the addition, to the resulting mixed solution of $RuOHCl_3$–$TiCl_4$ of a solution of iridium trichloride ($IrCl_3$).

The coating solution contains 2.4 cm$^3$ of the solution of $RuOHCl_3$, 6.7 cm$^3$ of the solution of $TiCl_4$ and 1.25 cm$^3$ of a solution of $IrCl_3$.

The resulting electrode (sample 2) corresponds, as regards its composition, to the known electrode according to U.S. Pat. No. 3,948,751.

The test results (sample 2) are shown in the Table.

An electrode is prepared as in Example 1, except that its active coating has the following composition, molar percent: $TiO_2$—78.95, $IrO_2$—7.25, $RuO_2$—13.8 at a ratio of $TiO_2$:($IrO_2$+$RuO_2$)=3.75:1 and $IrO_2$:-$RuO_2$=0.525:1.

For applications of the active coating, a coating solution is prepared by mixing the solutions mentioned in Example 1—$RuOHCl_3$ and $TiCl_4$ with the addition, to the resulting mixed solution of $RuOHCl_3$–$TiCl_4$, of a solution of iridium trichloride ($IrCl_3$).

The coating solution contains 4.4 cm$^3$ of a solution of $RuOHCl_3$, 6 cm$^3$ of a solution of $TiCl_4$ and 2.3 cm$^3$ of a solution of $IrCl_3$. The resulting electrode (sample 3) has a composition corresponding to that of the active coating of the known electrode of U.S. Pat. No. 3,948,751. The test results for sample 3 are shown in the Table below.

TABLE

| | | | | | Samples | | | | | | | | |
|---|---|---|---|---|---|---|---|---|---|---|---|---|---|
| Nos. | Characteristics | 1 | 2 | 3 | A | B | C | D | E | F | G | H | I |
| 1 | 2 | 3 | 4 | 5 | 6 | 7 | 8 | 9 | 10 | 11 | 12 | 13 | 14 |
| | Ratio of the oxides in the active mass, mol. % | | | | | | | | | | | | |
| 1 | $TiO_2$ | 67 | 88.66 | 78.95 | 70.8 | 70.0 | 70.0 | 75.0 | 50.0 | 63.5 | 55.6 | 66.7 | 45 |
| 2 | $IrO_2$ | — | 3.9I | 7.25 | 12.5 | 15.0 | 20.0 | 18.7 | 30.0 | 23.3 | 24.7 | 23.8 | 22 |
| 3 | $RuO_2$ | 33 | 7.43 | 13.8 | 16.7 | 15.0 | 10.0 | 6.3 | 20.0 | 13.2 | 19.7 | 9.5 | 33 |
| 4 | $TiO_2$:($IrO_2$ + $RuO_2$) | 2:I | 7.8:I | 3.75:I | 2.44:I | 2.33:I | 2.33:I | 3:I | I:I | I.75:I | I.25:I | 2:I | 0.82:I |
| 5 | $IrO_2$:$RuO_2$ | — | 0.528:I | 0.525:I | 0.75:I | I:I | 2:I | 3:I | I.5:I | I.75:I | I.25:I | 2.5:I | 0.67:I |
| | Anode potential under chlorine electrolysis conditions, V(NHE) at the current density, A/m$^2$: | | | | | | | | | | | | |
| 6 | I.000 | I.3 | I.45 | I.32 | I.30 | I.30 | I.30 | I.3I | I.32 | I.30 | I.30 | I.30 | I.3I |
| 7 | 2.000 | I.33 | I.50 | I.34 | I.32 | I.31 | I.31 | I.32 | I.33 | I.3I | I.3I | I.3I | I.32 |
| 8 | 4.000 | I.35 | I.55 | I.36 | I.35 | I.33 | I.33 | I.34 | I.35 | I.33 | I.32 | I.33 | I.34 |
| 9 | 6.000 | I.37 | I.60 | I.38 | I.36 | I.34 | I.34 | I.35 | I.36 | I.34 | I.33 | I.34 | I.36 |
| 10 | 10.000 | I.40 | I.62 | I.39 | I.37 | I.36 | I.35 | I.36 | I.37 | I.36 | I.35 | I.35 | I.37 |
| | Anode potential under chlorate electrolysis conditions, V(NHE), at the current density, A/m$^2$: | | | | | | | | | | | | |
| 11 | 1.000 | I.40 | | | | I.37 | I.36 | | | | | | |
| 12 | 2.000 | I.43 | | | | I.4I | I.40 | | | | | | |
| 13 | 3.000 | I.49 | | | | I.44 | I.43 | | | | | | |

TABLE-continued

| Nos. | Characteristics | 1 | 2 | 3 | A | B | C | D | E | F | G | H | I |
|---|---|---|---|---|---|---|---|---|---|---|---|---|---|
| | | | | | Samples | | | | | | | | |
| 1 | 2 | 3 | 4 | 5 | 6 | 7 | 8 | 9 | 10 | 11 | 12 | 13 | 14 |
| | Electrode resistance by the method of variable polarity and amalgamation, mg/cm$^2$ | | | | | | | | | | | | |
| 14 | | 0.2 | 0.4 | 0.3 | 0.15 | 0.07 | 0.05 | 0.08 | 0.17 | 0.5 | | | |
| | Electrode resistance in electrolysis in a solution of 200 g/l of NaOH, active mass loss (mg) during the time of electrolysis, hours: | | | | | | | | | | | | |
| 15 | 5 hrs | 0.4 | 0.3 | 0.6 | 0.3 | 0.1 | 0.2 | 0.1 | 0.3 | 0.4 | 0.2 | 0.1 | 0.3 |
| 16 | 10 hrs | 0.9 | 0.6 | 0.8 | 0.4 | 0.2 | 0.3 | 0.2 | 0.5 | 0.7 | 0.3 | 0.4 | 0.5 |
| 17 | 15 hrs | 1.2 | 0.9 | 1.2 | 0.6 | 0.3 | 0.5 | 0.4 | 0.9 | 0.9 | 0.4 | 0.5 | 0.7 |
| 18 | 20 hrs | 1.7 | 1.4 | 1.5 | 0.8 | 0.7 | 0.6 | 0.5 | 1.7 | 1.5 | 0.6 | 0.7 | 0.9 |
| 19 | 25 hrs | 2.1 | 1.8 | 2.0 | 0.9 | 1.1 | 0.8 | 0.9 | 2.5 | 2.1 | 0.7 | 0.8 | 1.1 |
| 20 | 30 hrs | | 2.4 | 2.5 | 1.7 | 2.5 | 1.8 | 1.2 | 3.1 | 2.7 | 1.1 | 1.3 | 1.7 |
| 21 | 40 hrs | | | 3.7 | 1.9 | 3.0 | 2.7 | 2.5 | 3.8 | 3.3 | 2.5 | 2.0 | 2.9 |
| 22 | 45 hrs | | | | 2.8 | 3.6 | 3.6 | 2.9 | 4.5 | 4.7 | 3.3 | 3.0 | |
| 23 | 50 hrs | | | | 4.0 | 5.0 | 4.2 | 3.3 | 5.2 | 4.5 | 4.7 | | |
| 24 | 55 hrs | | | | 4.6 | 5.3 | 5.0 | 3.6 | | | 5.0 | 5.1 | |
| 25 | 60 hrs | | | | 4.8 | 5.5 | 5.3 | 4.3 | | | 5.1 | 5.2 | |
| 26 | 70 hrs | | | | | 5.8 | 5.4 | 5.1 | | | 5.3 | 5.4 | |
| | Operation time till the anode breakdown, hrs | | | | | | | | | | | | |
| 27 | | 23 | 30 | 40 | 60 | 70 | 70 | 70 | 50 | 45 | 70 | 70 | 40 |
| | Initial charge of the active mass, mg | | | | | | | | | | | | |
| 28 | | 5.6 | 5.5 | 5.8 | 5.4 | 5.8 | 5.5 | 5.2 | 5.6 | 5.7 | 5.6 | 5.7 | 5.8 |

What is claimed is:

1. An electrode for electrolysis of solutions of electrolytes comprising a support of a passivated metal, a coating applied onto said support consisting of a mixture including titanium oxide, ruthenium oxide and iridium oxide, wherein the molar ratio of titanium oxide to the total of oxides of iridium and ruthenium is equal to 1–3:1 at a molar ratio of iridium oxide to ruthenium oxide equal to 0.75–3:1.

2. An electrode for electrolysis of solutions of electrolytes according to claim 1, comprising a coating, wherein the molar ratio of titanium oxide to the total of oxides of iridium and ruthenium is equal to 1.75–3:1 at a molar ratio of iridium oxide to ruthenium oxide equal to 0.75–1.75:1.

3. An electrode for electrolysis of solutions of electrolytes according to claim 1, comprising a coating, wherein the molar ratio of titanium oxide to the total of oxides of iridium and ruthenium is equal to 1.25–2.5:1 at a molar ratio of iridium oxide to ruthenium oxide equal to 1.25–2.5:1.

* * * * *